US007294667B2

(12) United States Patent
Teetzel

(10) Patent No.: US 7,294,667 B2
(45) Date of Patent: Nov. 13, 2007

(54) COATED ABRASIVE ARTICLES CONTAINING GRAPHITE

(75) Inventor: Michael L. Teetzel, Hugo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 565 days.

(21) Appl. No.: 10/412,125

(22) Filed: Apr. 11, 2003

(65) Prior Publication Data

US 2003/0204007 A1 Oct. 30, 2003

Related U.S. Application Data

(63) Continuation-in-part of application No. 09/779,681, filed on Feb. 8, 2001, now abandoned.

(51) Int. Cl.
*B60C 1/00* (2006.01)
*C04B 28/26* (2006.01)
*D06N 7/04* (2006.01)

(52) U.S. Cl. ..... 524/495; 524/442; 428/143; 428/144; 428/145; 428/146; 428/147; 428/148

(58) Field of Classification Search ..... 428/143–148; 524/495, 442

See application file for complete search history.

(56) References Cited

U.S. PATENT DOCUMENTS

| | | | | |
|---|---|---|---|---|
| 2,004,466 | A | 6/1935 | Dietz et al. | |
| 2,404,207 | A | 7/1946 | Ball | |
| 3,163,968 | A | 1/1965 | Nafus | |
| 3,166,388 | A | 1/1965 | Riegger et al. | |
| 3,168,387 | A | 2/1965 | Adams | |
| 3,266,878 | A | 8/1966 | Timmer et al. | |
| 3,367,851 | A | 2/1968 | Filreis et al. | |
| 3,377,264 | A | 4/1968 | Duke et al. | |
| 3,399,082 | A | 8/1968 | Henderson et al. | |
| 3,619,150 | A | 11/1971 | Rinker et al. | |
| 3,942,959 | A | 3/1976 | Markoo et al. | |
| 3,992,178 | A | 11/1976 | Markoo et al. | |
| 4,035,265 | A | 7/1977 | Saunders | |
| 4,347,104 | A | 8/1982 | Dressler | |
| 4,451,531 | A * | 5/1984 | Isobe et al. | 428/329 |
| 4,632,777 | A | 12/1986 | Nicholson | |
| 4,670,340 | A | 6/1987 | Isobe et al. | |
| 4,684,572 | A * | 8/1987 | Yasufuku et al. | 428/323 |
| 4,693,929 | A | 9/1987 | Ryoke et al. | |
| 4,696,835 | A | 9/1987 | Maus et al. | |
| 4,758,468 | A | 7/1988 | Takahashi et al. | |
| 4,826,508 | A | 5/1989 | Schwartz et al. | |
| 4,909,901 | A | 3/1990 | McAllister et al. | |
| 4,960,442 | A | 10/1990 | Wagner et al. | |
| 4,971,726 | A | 11/1990 | Maeno et al. | |
| 4,973,338 | A | 11/1990 | Gaeta et al. | |
| 5,061,294 | A | 10/1991 | Harmer et al. | |
| 5,108,463 | A | 4/1992 | Buchanan | |
| 5,137,542 | A | 8/1992 | Buchanan et al. | |
| 5,137,667 | A | 8/1992 | Fujii et al. | |
| 5,328,716 | A | 7/1994 | Buchanan | |
| 5,389,119 | A | 2/1995 | Ferronato et al. | |
| 5,560,753 | A | 10/1996 | Schnabel et al. | |
| 5,595,804 | A * | 1/1997 | Korbel | 428/57 |
| 5,633,068 | A * | 5/1997 | Ryoke et al. | 428/143 |
| 5,856,398 | A | 1/1999 | Oizumi et al. | |
| 5,919,549 | A | 7/1999 | Van et al. | |
| 5,922,784 | A | 7/1999 | DeVoe et al. | |
| 6,066,188 | A | 5/2000 | Benedict et al. | |
| 6,524,681 | B1 * | 2/2003 | Seitz et al. | 428/143 |
| 6,696,125 | B2 * | 2/2004 | Zanchetta et al. | 428/40.1 |
| 2002/0146963 | A1 | 10/2002 | Teetzel | |

FOREIGN PATENT DOCUMENTS

| | | |
|---|---|---|
| AU | 67400/74 | 10/1975 |
| DE | 77 20 014 | 10/1977 |
| DE | 39 15 810 A1 | 12/1989 |
| EP | 414 494 B1 | 6/1994 |
| GB | 885192 | 12/1961 |
| GB | 1471758 | 4/1977 |
| GB | 2018811 | 10/1979 |
| JP | 58-171264 | 10/1983 |
| JP | 58-177270 | 10/1983 |
| JP | 61-33868 | 7/1986 |
| JP | 61-152373 | 7/1986 |
| JP | 61-265279 | 11/1986 |
| WO | WO 92/01536 | 2/1992 |
| WO | WO 93/12911 A1 | 2/1992 |
| WO | WO 92/02336 A1 | 7/1993 |
| WO | WO 94/15344 | 7/1994 |
| WO | WO 96/30164 | 10/1996 |

OTHER PUBLICATIONS

English translation of Technical Bulletin No. 40 entitled, "Pigment Carbon Black for Plastics" Degussa, 1995 (25 pages).

Carbocure TSR-72 Emulsion material safety data sheet, Apr. 21, 1988 (8 pages).

"Carbocure FF Series Formaldehyde—Free Self-Crosslinking Acrylic Emulsion" product literature, B.F. Goodrich, Sep. 1994 (1 page).

"Carbocure TSR Series Acrylic Emulsions for High-Performance Paper and Nonwoven Applications" product literature, B.F. Goodrich, Sep. 1994 (7 pages).

* cited by examiner

*Primary Examiner*—Cephia D. Toomer
(74) *Attorney, Agent, or Firm*—Bradford B. Wright

(57) ABSTRACT

Coated abrasive articles comprise a composition comprising binder and at least about 25% by weight graphite particles, based on the total solids content of the composition.

13 Claims, No Drawings

COATED ABRASIVE ARTICLES CONTAINING GRAPHITE

CROSS-REFERENCE TO RELATED APPLICATION

This application is a continuation-in-part of U.S. Application No. 09/779,681, filed Feb. 8, 2001, now abandoned.

BACKGROUND OF THE INVENTION

The invention relates to abrasive articles containing graphite.

Many sanding operations utilize a platen to apply belt pressure to the workpiece. In many instances, the pressure applied to the belt with the platen leads to excessive wear of the belt and plate, as well as excessive heat generation. Higher temperatures can damage the platen, sanding belt and, ultimately, the workpiece.

In another aspect, coated abrasive articles such as sanding belts often generate static electricity during use in abrading and finishing wood and wood-like materials. Static electricity is generated by the constant separation of the abrasive product from the work piece, the machinery drive rolls, idler rolls, and support pad of the abrasive product. Static electric charge problems tend to be more pronounced when abrading an electrically insulating or semi-insulating workpiece, for example, wood, plastic, and mineral workpieces, as well as workpieces coated with insulating material.

Static electricity can cause, for example, ignition of wood dust particles. Static electric charge can also cause sawdust to cling to various surfaces (e.g., the coated abrasive, the abrading machine, and the electrically insulating wood workpiece), which can render the sawdust difficult to remove by use of conventional exhaust systems.

Various attempts have been made to reduce the generation of static electric charge and improve platen compatibility during sanding operations (e.g., applying compositions that include graphite or carbon particles to the abrasive grain side of an abrasive article and applying electrically conductive particles to the backing of a coated abrasive article). Compositions have also been applied to the surface of the platen in order to minimize wear and improve thermal conductivity of the platen.

SUMMARY OF THE INVENTION

In one aspect, the invention features a composition comprising binder precursor, at least about 25% (preferably, in increasing order of preference, at least about 30%, at least about 35%, at least about 40%, at least about 45%, at least about 50%, at least about 55%, at least about 60%, or at least about 65%) by weight graphite particles, based on the total solids content of the composition, and second particles having a median diameter no greater than about 200 micrometers (i.e., the median particle size of the plurality of particles is no greater than about 200 micrometers), "particle size" is the longest dimension of a particle. In some embodiments, the second particles have a particle diameter of no greater than about 100 micrometers. In one embodiment, the second particles are present in the composition in an amount of at least about 5% by weight, based on the total solids content of the composition. In some embodiments, the second particles are present in the composition in an amount of at least about 10% by weight, based on the total solids content of the composition.

In another embodiment, the second particles are selected from the group consisting of calcium carbonate, carbon black, iron oxide, silica, silicates, clay, feldspar, mica, calcium silicate, calcium metasilicate, sodium aluminosilicate, sodium silicate, calcium sulfate, barium sulfate, sodium sulfate, aluminum sodium sulfate, aluminum sulfate, gypsum, vermiculite, aluminum trihydrate, aluminum oxide, titanium dioxide, cryolite, chiolite, metal sulfite, and mixtures thereof. In other embodiments, the second particles are selected from the group consisting of calcium carbonate, carbon black, and mixtures thereof.

In one embodiment, the binder includes a resin selected from the group consisting of acrylic, acrylate, phenolic, epoxy, urethane, neoprene, melamine-formaldehyde, and combinations thereof.

In another aspect, the invention features a composition comprising a binder precursor selected from the group consisting of acrylic, acrylate, phenolic, epoxy, melamine-formaldehyde urethane, neoprene, and combinations thereof, and at least 37% (preferably, in increasing order of preference, at least about 40%, at least about 45%, at least about 50%, at least about 55%, at least about 60%, or at least about 65%) by weight graphite particles, based on the total solids content of the composition. In one embodiment, the composition includes an acrylic binder precursor, and at least 37% by weight graphite particles, based on the total solids content of the composition.

In another aspect, the invention features an abrasive article including a backing having a first major surface and a second major surface opposite the first major surface, a first layer disposed on the first major surface of the backing, the first layer including abrasive particles and binder, and a second layer disposed on a second major surface of the backing, where the second layer includes a composition according to the present invention.

In another aspect, the invention features a method of making an abrasive article and the method including coating a composition onto the surface of a backing, the composition including binder precursor, at least about 25% by weight graphite particles, based on the total weight of the composition, and second particles having a median diameter no greater than about 200 micrometers. In some embodiments, the second particles have a particle diameter of no greater than about 100 micrometers.

In another aspect, the invention features a method of making an abrasive article, the method including coating a composition onto the surface of a backing, the composition including a binder precursor selected from the group consisting of acrylic, acrylate, phenolic, epoxy, melamine-formaldehyde, and combinations thereof, and at least 37% by weight graphite particles based on the total weight of the composition.

In another aspect, the invention features an article that includes a substrate (e.g., a platen), and a composition disposed on the substrate, the composition including binder, at least about 25% by weight graphite particles based on the total weight (i.e., solids content) of the composition and second particles having a median diameter no greater than about 200 micrometers. In some embodiments, the second particles have a particle diameter of no greater than about 100 micrometers.

In another aspect, the invention features an article that includes a substrate, and a composition disposed on the substrate, the composition including acrylic binder, and at least 37% by weight graphite particles, based on the total weight (i.e., solids content) of the composition.

In another aspect, the invention features a method of abrading a workpiece using an apparatus including a platen and an endless belt, the belt having a first major surface and a second major surface opposite the first major surface, the belt including an abrasive coating disposed on the first major surface of the belt and a second coating including a composition according to the present invention disposed on the second major surface of the belt, the second coating being in contact with the platen, the method including abrading the workpiece with the abrasive surface of the belt. In some embodiments, the platen experiences a temperature of no greater than 100° C. during the abrading.

In some embodiments, when a composition is tested according to the Platen Compatibility Test Method, the platen of the test method experiences a temperature of no greater than 100° C. (preferably, no greater than 90° C., more preferably, no greater than 85° C.).

In some embodiments, compositions according to the present invention, when the binder precursor is converted to binder (e.g., cured), have an electrical resistivity of no greater than 2000 ohms per square, no greater than 150 ohms per square, no greater than 100 ohms per square, or no greater than 75 ohms per square.

In some embodiments, compositions according to the present invention have a viscosity no greater than about 20,000 cPs at a temperature of 25° C., a viscosity no greater than about 1000 cPs at a temperature of 25° C., a viscosity of no greater than about 800 cPs at a temperature of 25° C., a viscosity of no greater than about 600 cPs at a temperature of 25° C., or a viscosity of no greater than about 350 cPs at a temperature of 25° C.

The invention features a composition that includes a relatively large percent by weight graphite particles, such that articles coated with the composition exhibit good platen compatibility and electrical conductivity. The composition also has a viscosity suitable for application using a commercial coating apparatus.

Abrasive articles that include a coating of the electrically conductive composition generate little to no static electric charge when the coating is placed in contact with the sanding apparatus (e.g., the platen of the sanding machine). Further, abrasive articles that include the electrically conductive coating typically have a reduced tendency of dust to stick to the sanding apparatus with which they are used.

The coating also provides good platen compatibility such that the increase in temperature of the platen during an abrading operation is minimized.

Other features of the invention will be apparent from the following description of the preferred embodiments thereof, and from the claims.

DETAILED DESCRIPTION

Compositions, according to the present invention, comprise graphite particles in a binder, typically the graphite particles are disposed in the binder material such that they are dispersed homogeneously throughout the binder.

Preferably, the graphite particles are present in an amount sufficient to maximize the electrical conductivity of the resulting cured composition, while maintaining an uncured composition having a viscosity suitable for coating. The graphite particles may be in a variety of forms including flake, amorphous, vein, fiber, and combinations thereof. Preferably, the graphite is flake graphite. In another aspect, the composition preferably comprises at least about 25% by weight, more preferably at least 37% by weight, even more preferably at least about 45% by weight, and most preferably at least about 65% by weight, based on the total solids content of the composition (i.e., the weight of the composition when fully cured). Typically, increasing amounts of graphite lead to increasing platen compatibility and/or electrical conductivity.

Suitable graphite particles typically have an average median particle diameter no greater than about 200 micrometers, preferably no greater than about 100 micrometers, more preferably no greater than about 50 micrometers. Particle sizes within these ranges typically allow higher graphite concentrations in the composition, balanced with desirable viscosity values. Examples of useful commercially available graphite include flake graphite available, for example, under the trade designations "GRADE 3264" from Asbury Graphite Mills Inc. (Asbury, N.J.), and "DIXON 1448" and "DIXON 1472" from Industrial Lubricants, a Division of Asbury Carbon (Asbury, N.J.).

Prior to cure, the binder is in the form of a binder precursor. The binder precursor is preferably selected to optimize the amount of graphite particles present in the composition. The binder precursor is preferably in the form of an aqueous dispersion that includes a polymerizable component, a crosslinkable component, or a combination thereof, prior to cure. Examples of useful binder precursors include acrylic resins, acrylate resins, urethane resins, epoxy resins, phenolic resins, melamine-formaldehyde resins, urethane resins, neoprene resins, and combinations and mixtures thereof. Useful commercially available aqueous polymerizable emulsions include acrylic self-curing emulsions available, for example, under the trade designation "CARBOCURE TSR72" from Noveon, Inc. (formerly the Performance Materials Segment of B. F. Goodrich, Cleveland, Ohio).

The binder precursor is preferably present in the composition in an amount of no greater than about 90% by weight, more preferably from about 15% by weight to about 60% by weight, based on the total solids content of the composition.

The composition may also include particles (e.g., filler particles) in addition to the graphite particles. Such particles are preferably insoluble in the binder precursor. The nature and amount of filler particles are selected to provide a composition having a coatable viscosity, while optimizing the amount of graphite particles present in the composition. The filler particles have a diameter less than the diameter of the graphite particles. Useful filler particles may have an average particle diameter no greater than the average particle diameter of the graphite particles, preferably no greater than about 100 micrometers, more preferably no greater than about 50 micrometers, and most preferably no greater than about 25 micrometers. The preferred diameters tend to allow higher graphite concentrations in the compositions, balanced with desirable viscosity values.

One example of preferred filler particles is calcium carbonate. Suitable calcium carbonate particles typically have an average diameter from about 0.1 nm to about 100 nm, more preferably from about 0.3 nm to about 75 nm, most preferably from about 2 to about 50 nm. Suitable calcium carbonate particles are commercially available, for example, under the trade designation "GEORGIA MARBLE No. 10" from Georgia Marble (Gantt's Quarry, Ala.) and "MICROWHITE 25" from ECC International (Sylacauga, Ala.).

Calcium carbonate is preferably present in the composition in an amount of no greater than about 30% by weight, more preferably from about 15% by weight to about 25% by weight, most preferably about 20% by weight, based on the total solids content of the composition. Calcium carbonate in the preferred ranges tend to allow for higher graphite concentrations in the compositions, balanced with the desirable viscosity values.

Another useful filler is carbon black. Suitable carbon black particles typically have an average diameter in the range of about 10 nm to about 90 nm, more preferably from about 10 nm to about 60 nm, most preferably from about 10 to about 40 nm. Useful carbon black dispersions are commercially available, for example, under the trade designation "KW-3729 AQUIS II" from Heubach (Fairless Hills, Pa.). Preferably, carbon black is present in the composition in an amount of no greater than about 50% by weight, preferably from about 1% by weight to about 20% by weight, more preferably from about 3% by weight to about 10% by weight, most preferably about 5% by weight, based on the total solids content of the composition. Carbon black in the preferred sizes and amounts tend to allow for higher graphite concentrations in the composition, balanced with desirable viscosity values.

Examples of other useful filler particles include iron oxide, silica (e.g., quartz), silicates (e.g., talc), clays (e.g., montmorillonite), feldspar, mica, calcium silicate, calcium metasilicate, sodium aluminosilicate and sodium silicate, metal sulfates (e.g., calcium sulfate, barium sulfate, sodium sulfate, aluminum sodium sulfate and aluminum sulfate), gypsum, vermiculite, wood flour, aluminum trihydrate, aluminum oxide, titanium dioxide, cryolite, chiolite and metal sulfites (e.g., calcium sulfite), and mixtures thereof. In preferred embodiments, the composition contains less than 10% by weight (increasingly more preferable, less than 5%, 1%, 0.5%, or 0.1% by weight) based on the total solids content of the composition, waxes, and fatty acids (e.g., high boiling point (i.e., 190° C. to about 300° C.) aliphatic hydrocarbons), although typically, the composition is essentially free of waxes and fatty acids. Typically, use of waxes and fatty acids is undesirable because it tends to lead to "smearing" when the composition is rubbed against a surface (e.g., a platen).

The uncured composition has a viscosity suitable for coating. Preferred uncured compositions have a viscosity of no greater than about 100,000 cPs, no greater than about 20,000 cPs, no greater than about 10,000 cPs, preferably no greater than 5000 cPs, more preferably no greater than 1000 cPs at room temperature (i.e., about 25° C.).

Upon drying, or in the case of curable compositions, upon curing, the composition typically forms an electrically conductive coating having a surface resistivity no greater than 2000 ohms/square, preferably no greater than 200 ohms/square, more preferably no greater than about 150 ohms/square, even more preferably no greater than about 100 ohms/square, most preferably no greater than about 75 ohms/square. Surface resistivity is measured by placing the probes of an ohmmeter 1.4 cm apart on the coated cured composition. Examples of useful commercially available ohmmeters are available, for example, under the trade designations "BECKMAN INDUSTRIAL DIGITAL MULTIMETER MODEL 4410" from Beckman Industrial Corp. (Brea, Calif.) and "INDUSTRIAL DEVELOPMENT BANGOR SURFACE RESISTIVITY METER MODEL 482" from Bangor (Gwynedd, Wales).

The cured composition is well suited for use in a variety of abrasive articles including sheets, rolls, belts (e.g., endless belts, including spiral wound and composite belts), and discs. The abrasive article preferably includes a backing having a first major surface and a second major surface opposite the first major surface, and an abrasive layer disposed on the first major surface of the backing. The cured composition is disposed on at least the second major surface of the backing such that the cured composition is available for contact with a platen of a sanding apparatus. When used in combination with an abrading apparatus that includes a platen, the platen preferably experiences minimal increase in temperature. Excessive heating of the platen can cause additional wear on the platen and can decrease the useful life of the abrasive belt. Preferably, the platen experiences a temperature of no greater than 100° C., more preferably no greater than 90° C., most preferably no greater than 85° C. Excessive heat can be an indication of excessive friction between the abrasive article and the platen.

Examples of suitable backings include paper, cloth (e.g., woven and non-woven), fiber, polymeric film, laminates, and treated versions thereof. The backing may be treated to include a presize (i.e., a barrier coat overlying the major surface of the backing onto which the abrasive layer is applied), a backsize (i.e., a barrier coat overlying the major surface of the backing opposite the major surface on which the abrasive layer is applied), a saturant (i.e., a barrier coat that is coated on all exposed surfaces of the backing), or a combination thereof. Useful presize, backsize and saturant compositions include glue, phenolic resins, lattices, epoxy resins, urea-formaldehyde, urethane, melamine-formaldehyde, neoprene rubber, butyl acrylate, styrol, starch, and combinations thereof.

The abrasive article can be prepared, for example, by first coating the backing with a first binder material, often referred to as a "make coat," and then applying abrasive grains to the binder material. Alternatively, for example, the abrasive article can be prepared by applying a slurry coat to the backing, where the slurry includes abrasive grains distributed throughout a binder precursor. In some embodiments, the abrasive grains are oriented and in other embodiments the abrasive grains are without orientation. For wood finishing operations, it is often preferred that the abrasive grains be electrostatically applied so that a greater proportion of the grains have their longer axis more nearly perpendicular to the plane of the backing. The resulting abrasive layer is then generally solidified (e.g., partially cured) or set sufficiently to retain the abrasive gains on the support member.

Examples of useful binder compositions for the abrasive layer include phenolic resins, urea-formaldehyde resins, melamine-formaldehyde resin, acrylate resins, urethane resins, epoxy resins, and combinations and mixtures thereof. The binder composition for the abrasive layer can also include various additives including, for example, grinding aids, plasticizers, fillers, fibers, lubricants, surfactants, wetting agents, dyes, pigments, antifoaming agents, dyes, coupling agents, plasticizers, and suspending agents.

Suitable abrasive grains include oxides of metals such as aluminum (e.g., fused aluminum oxide, heat-treated aluminum oxide, and ceramic aluminum oxide), co-fused alumina-zirconia, ceria, garnet, silicon carbide, diamond, cubic boron nitride, boron carbides, corundum, zircon corundum, spinel corundum, ruby, flint, emery, and mixtures thereof.

A second layer of binder composition, often referred to as a "size coat," can be applied to the abrasive layer. The size coat further reinforces the coated abrasive product. Suitable size coat compositions include phenolic resins, urea-formaldehyde resins, melamine-formaldehyde resin, acrylate resins, urethane resins, epoxy resins, and combinations and mixtures thereof. The size coat can also include various additives including grinding aids, plasticizers, fillers (e.g., cryolite), fibers, lubricants, surfactants, wetting agents, dyes, pigments, antifoaming agents, dyes, coupling agents, plasticizers, suspending agents, and mixtures thereof.

Optionally, an additional overcoating, often referred to as a "supersize coat," which may contain grinding aids and other well known additives, can be applied over the size coat. Examples of useful supersize coating compositions include metal salts of fatty acids, urea-formaldehyde, novolac phenolic resins, epoxy resins, waxes, and mineral oils.

Embodiments of this invention are further illustrated by the following examples, but the particular materials and amounts thereof recited in these examples, as well as other conditions and details, should not be construed to unduly limit this invention. All parts, ratios, percentages and amounts stated in the Examples are by weight unless otherwise specified.

EXAMPLES

Test Procedures

Test procedures used in the examples include the following.

Electrical Resistivity Test Method

The electrical resistivity of a composition, in ohms/square, is measured by placing probes of a "BECKMAN INDUSTRIAL DIGITAL MULTIMETER MODEL 4410" ohmmeter (Beckman Industrial Corp., Brea, Calif.) 1.4 cm apart on a layer of the cured composition (cured coating weight of 0.88 0oz/yd$^2$ (29.8 g/m$^2$)) disposed on a woven polyester substrate.

Viscosity

The viscosity of various compositions were determined using a viscometer obtained under the trade designation-"BROOKFIELD SYCHRO-LECTRIC VISCOMETER" (Model LTV) from Brookfield, Stoughton, Mass., with the appropriate spindle. For viscosities in the range from about 40-100 cPS, spindle No. 1, at an rpm of 12, was used. For viscosities in the range from about 100-900 cPS, spindle No. 2, at an rpm of 30, was used. For viscosities in the range from about 900-3,600 cPS, spindle No. 3, at an rpm of 30, was used. For viscosities in the range from about 3,600-10,000 cPS, spindle No. 4, at an rpm of 60, was used.

Platen Compatibility Test Method

The platen compatibility test was run on a modified BADER three wheel backstand grinder (available under the trade designation "BADER" from Stephen Bader Co., Valley Falls, N.Y.) fitted with a platen that includes a 2-inch (5.1 cm) thick aluminum head covered with a Friction Fighter #450 graphite coated friction pad (i.e., platen cover) (available under the trade designation "FRICTION FIGHTER #450" from Process Engineering, (Crystal Lake, Ill.)). The drive wheel of the backstand grinder has a 3-inch (7.6 cm) radius and the idler wheel has a 6-inch (15.2 cm) radius. A thermocouple is mounted on the surface of the aluminum head.

A 3 in.×120 in. (7.6 cm×30.5 cm) sanding belt having a sample graphite composition coated on a side of the belt opposite the abrasive side is mounted on the Bader grinder so that the backside of the belt slides over the graphite pad covered aluminum head. The belt is tensioned at 20 lbs/in (17.4 kg/cm) of belt width. The belt is then run over the graphite pad platen construction for 30 minutes. The temperature behind the graphite pad is recorded in degrees centigrade (° C.), once every minute; the highest temperature achieved is also recorded.

The weight of the graphite pad is measured before and after the test and the difference between the two measurements is reported as the amount of platen wear in grams (g).

Examples 1-10

Example 1, a 50% solids composition was prepared by combining, on a solids basis, 29.5% aqueous acrylic emulsion (obtained as a 34% solids emulsion under the trade designation "CARBOCURE TSR 72" from B. F. Goodrich, Cleveland, Ohio), 25% graphite flake powder having a particle of from 14-20 micrometers as reported by the manufacturer (obtained under the trade designation "GRADE 3264" from Asbury Graphite Mills Inc., Asbury, N.J.), 0.5% ethoxylated oleic acid surfactant (obtained under the trade designation "EMULON A" from BASF Corp., Mount Olive, N.J.), 5% of a 33% carbon black composition (obtained under the trade designation "KW-3729, AQUIS II" from Heucotech Ltd., Fairless Hills, Pa.) and 40% calcium carbonate having a particle size less than 46 micrometers and an average particle size of about 15 micrometers as reported by the manufacturer (obtained under the trade designation "GEORGIA MARBLE NO. 10" from Georgia Marble, Gantts' Quarry, Ala.) and slowly and continuously mixing for 30 minutes to form a uniform dispersion.

Example 2 was prepared according to the composition of Example 1, with the exception that the composition included 45% graphite and 20% calcium carbonate.

Example 3 was prepared according to the composition of Example 1, with the exception that the composition included 55% graphite and 10% calcium carbonate.

Example 4 was prepared according to the composition of Example 1, with the exception that the composition included 65% graphite and no calcium carbonate.

Example 5 was prepared according to the composition of Example 1, with the exception that the composition included 50% graphite and no carbon black.

Example 6 was prepared according to the composition of Example 1, with the exception that the composition included 50% graphite, no calcium carbonate and no carbon black.

Example 7 was prepared according to the composition of Example 1, with the exception that the composition included 65% graphite, no calcium carbonate and no carbon black.

Example 8, a 45% solids composition, was prepared by combining, on a solids basis, 29.5% aqueous acrylic emulsion ("CARBOCURE TSR 72"), 45% graphite powder ("GRADE 3264"), 0.5% ethoxylated oleic acid surfactant ("EMULON A"), 5% of a 33% carbon black composition ("KW-3729, AQUIS II") and 20% calcium carbonate having a particle size less than 46 micrometers and an average particle size of about 15 micrometers as reported by the manufacturer ("GEORGIA MARBLE NO. 10"), and slowly and continuously mixing for 30 minutes to form a uniform dispersion.

Example 9, a 55% solids composition, was prepared by combining, on a solids basis, 29.5% aqueous acrylic emulsion ("CARBOCURE TSR 72"), 45% graphite powder ("GRADE 3264"), 0.5% ethoxylated oleic acid surfactant ("EMULON A"), 5% of a 33% carbon black composition ("KW-3729, AQUIS II") and 20% calcium carbonate having a particle size less than 46 micrometers and an average particle size of about 15 micrometers as reported by the manufacturer ("GEORGIA MARBLE NO. 10"), and slowly and continuously mixing for 30 minutes to form a uniform dispersion.

Example 10, a 59% solids composition, was prepared by combining, on a solids basis, 29.5% aqueous acrylic emulsion ("CARBOCURE TSR 72"), 45% graphite powder ("GRADE 3264"), 0.5% ethoxylated oleic acid surfactant ("EMULON A"), 5% of a 33% carbon black composition ("KW-3729, AQUIS II") and 20% calcium carbonate having a particle size less than 46 micrometers and an average particle size of about 15 micrometers as reported by the manufacturer ("GEORGIA MARBLE NO. 10"), and slowly and continuously mixing for 30 minutes to form a uniform dispersion.

The viscosity of the compositions of Examples 1-10 was measured and is reported in Table 1. The compositions of Examples 1-10 were then coated on a backing at a solids coating weight of 0.88 oz/yd$^2$ (29.8 g/m$^2$) and tested according to the Electrical Resistivity Test Method. The results are reported in Table 1, below.

TABLE 1

| Example | % Solids | Viscosity, cPs | Surface Resistivity, ohms/square | Platen Temp. Range, ° C. | Platen Wear, g |
|---|---|---|---|---|---|
| 1 | 50 | 85 | 130-135 | 47-72 | 2.0 |
| 2 | 50 | 340 | 45-50 | 23-66 | 1.8 |
| 3 | 50 | 950 | 40-45 | 47-68 | 1.6 |
| 4 | 50 | 1160 | 35-40 | 39-63 | 1.1 |
| 5 | 50 | 680 | 70-75 | 46-72 | 1.6 |
| 6 | 50 | 425 | 70-75 | 44-77 | 1.7 |
| 7 | 50 | 1600 | 30 | 41-62 | 1.0 |
| 8 | 45 | 90 | 30-35 | 41-87 | 2.0 |
| 9 | 55 | 960 | 25-30 | 47-83 | 1.6 |
| 10 | 59 | 3200 | 25-30 | 47-83 | 1.4 |

Example 11

A 50% solids composition was prepared by combining, on a solids basis, 29.5% aqueous acrylic emulsion ("CARBOCURE TSR 72"), 45% graphite powder ("GRADE 3264"), 0.5% ethoxylated oleic acid surfactant ("EMULON A"), 5% of a 33% carbon black composition ("KW-3729, AQUIS II") and 20% calcium carbonate having a particle size less than 46 micrometers and an average particle size of about 15 micrometers as reported by the manufacturer (obtained under the trade designation "GEORGIA MARBLE NO. 10"), and slowly and continuously mixing for 30 minutes to form uniform dispersion.

Example 12 was prepared as described in Example 11, with the exception that the binder was acrylic latex (obtained under the trade designation "HYCAR 2679" from B. F. Goodrich).

Example 13 was prepared as described in Example 11, with the exception that the binder was aqueous acrylic emulsion (obtained under the trade designation "CARBOCURE TSR 5" from B. F. Goodrich).

Example 14 was prepared as described in Example 11, with the exception that the binder was polyurethane (obtained under the trade designation "SANCURE 825" from B. F. Goodrich Specialty Chemicals, Cleveland, Ohio).

Example 15 was prepared as described in Example 11, with the exception that the binder was phenolic latex (obtained under the trade designation "GP 387D51" from Georgia Pacific Resins, Inc., Decatur, Ga.).

Example 16 was prepared as described in Example 11, with the exception that the binder was epoxy resin (obtained under the trade designation "EPIREZ 3522-W60" from Shell, Ireland, Fla.).

Example 17 was prepared as described in Example 11, with the exception that the calcium carbonate had a mean particle size of 2.5 to 4.5 micrometers as reported by the manufacturer (obtained under the trade designation "MICROWHITE" from ECC International, Sylacauga, Ala.).

Example 18 was prepared as described in Example 11, with the exception that the graphite had an average particle size of 5-15 micrometers as reported by the manufacturer (obtained under the trade designation "DIXON 1472" from Dixon Industrial Lubricants, a Division of Asbury Carbon, Asbury, N.J.).

Example 19 was prepared as described in Example 11, with the exception that the graphite had an average particle size of 40-50 micrometers as reported by the manufacturer (obtained under the trade designation "DIXON 1448" from Dixon Industrial Lubricants).

Example 20 was prepared as described in Example 11, with the exception that 5% calcium carbonate having a mean particle size of 2.5 to 4.5 micrometers as reported by the manufacturer ("MICROWHITE") was used in place of 5% carbon black.

Example 21 was prepared as described in Example 11, with the exception that 5% red iron oxide having an average particle diameter of 0.35 micrometers as reported by the manufacturer (obtained under the trade designation "KROMA RO-3097" from Elementis Pigments, Inc. East St. Louis, Ill.), was used in place of 5% carbon black.

Example 22 was prepared as described in Example 11, with the exception that 5% red iron oxide having an average particle diameter of 0.35 micrometer as reported by the manufacturer ("KROMA RO-3097") was used in place of 5% carbon black, and the calcium carbonate had a mean particle size of 2.5 to 4.5 micrometers, as reported by the manufacturer ("MICROWHITE").

Example 23 was prepared as described in Example 11, with the exception that 20% barium sulfate having an average particle diameter of 3 micrometers was used in place of 20% calcium carbonate.

The viscosity of compositions of Examples 11-23 was measured and the results are reported in Table 2, below. Each of the compositions of Examples 11-23 were coated on a treated Sateen polyester warp, nylon filled 9.56 oz/yd$^2$ (324 g/m$^2$) backing at a solids coating weight of 0.88 oz/yd$^2$ (29.8 g/m$^2$) using a 26 mire rod coater and dried in an abrasive cloth treating oven at 120° C. for 4 minutes. The samples were then tested according to the Electrical Resistivity Test Method.

The results are reported in Table 2, below.

TABLE 2

| Example | Binder | Viscosity, cPs | Resistance, ohm/square |
|---|---|---|---|
| 11 | Acrylic | 450 | 65 |
| 12 | Acrylic | 190 | 70 |
| 13 | Acrylic | 126 | 100 |
| 14 | Urethane | 470 | 65 |
| 15 | Phenolic | 1120 | 85 |
| 16 | Epoxy | 300 | 235 |
| 17 | Acrylic | 340 | 48 |
| 18 | Acrylic | 250 | 60 |
| 19 | Acrylic | 230 | 1060 |
| 20 | Acrylic | 260 | 190 |
| 21 | Acrylic | 280 | 250 |
| 22 | Acrylic | 260 | 120 |
| 23 | Acrylic | 310 | 52 |

Various modifications and alterations of this invention will become apparent to those skilled in the art without departing from the scope and spirit of this invention, and it should be understood that this invention is not to be unduly limited to the illustrative embodiments set forth herein. Other embodiments are within the claims.

What is claimed is:

1. A coated abrasive article comprising:

a backing having a first major surface and a second major surface opposite said first major surface;

a first layer disposed on said first major surface of said backing, said first layer comprising make and size coats and abrasive particles, wherein the make and size coats each comprise binder resin; and a second layer disposed on a second major surface of said backing, said second layer comprising a composition comprising:

binder resin;

at least about 25% by weight graphite particles, based on the total solids content of the composition; and second particles having a median diameter no greater than about 200 micrometers.

2. The coated abrasive article of claim 1, comprising at least about 30% by weight graphite particles, based on the total solids content of the composition.

3. The coated abrasive article of claim 1, comprising at least about 40% by weight graphite particles, based on the total solids content of the composition.

4. The coated abrasive article of claim 1, comprising at least about 50% by weight graphite particles, based on the total solids content of the composition.

5. The coated abrasive article of claim 1, comprising at least about 60% by weight graphite particles, based on the total solids content of the composition.

6. The coated abrasive article of claim 1, wherein the binder resin is selected from the group consisting of urethane resins, acrylate resins, phenolic resins, epoxy resins, melamine-formaldehyde resins, and combinations thereof.

7. The coated abrasive article of claim 1, wherein said second particles are selected from the group consisting of calcium carbonate, carbon black, iron oxide, silica, silicates, clay, feldspar, mica, calcium silicate, calcium metasilicate, sodium aluminosilicate, sodium silicate, calcium sulfate, barium sulfate, sodium sulfate, aluminum sodium sulfate, aluminum sulfate, gypsum, vermiculite, aluminum trihydrate, aluminum oxide, titanium dioxide, cryolite, chiolite, metal sulfite, and mixtures thereof.

8. The coated abrasive article of claim 1, wherein said second particles are selected from the group consisting of calcium carbonate, carbon black, and mixtures thereof.

9. The coated abrasive article of claim 1, wherein said second particles have a median diameter of no greater than about 100 micrometers.

10. A coated abrasive article comprising:

a backing having a first major surface and a second major surface opposite said first major surface;

a first layer disposed on said first major surface of said backing, said first layer comprising make and size coats and abrasive particles, wherein the make and size coats each comprise binder resin; and a second layer disposed on a second major surface of said backing, said second layer comprising a composition comprising:

binder selected from the group consisting of acrylate resins, phenolic resins, epoxy resins, melamine-formaldehyde resins, urethane resins, and combinations thereof; and at least 37% by weight graphite particles, based on the total solids content of the composition.

11. The coated abrasive article of claim 10, comprising at least about 50% by weight graphite particles, based on the total solids content of the composition.

12. The coated abrasive article of claim 10, comprising at least about 60% by weight graphite particles, based on the total solids content of the composition.

13. The coated abrasive article of claim 10, wherein the binder resin comprises phenolic resin.

* * * * *